US012590538B2

(12) United States Patent
Gisolf et al.

(10) Patent No.: US 12,590,538 B2
(45) Date of Patent: Mar. 31, 2026

(54) METHOD AND APPARATUS FOR STRESS TESTING OF GEOLOGICAL FORMATIONS WITH A HIGH PERMEABILITY

(71) Applicant: Schlumberger Technology Corporation, Sugar Land, TX (US)

(72) Inventors: Adriaan Gerard Gisolf, Bucharest (RO); German David Garcia, Sugar Land, TX (US); Francois-Xavier Dubost, Paris (FR); Emilie Peyret, Bucharest (RO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/810,563

(22) Filed: Aug. 21, 2024

(65) Prior Publication Data

US 2026/0055700 A1 Feb. 26, 2026

(51) Int. Cl.

| | |
|---|---|
| ***E21B 49/08*** | (2006.01) |
| ***E21B 33/124*** | (2006.01) |
| ***E21B 43/26*** | (2006.01) |
| ***E21B 49/00*** | (2006.01) |

(52) U.S. Cl.

CPC ..... *E21B 49/087* (2013.01); *E21B 43/26* (2013.01); *E21B 49/006* (2013.01); *E21B 33/124* (2013.01)

(58) Field of Classification Search

CPC ..... E21B 49/087; E21B 43/26; E21B 49/006; E21B 33/124

See application file for complete search history.

(56) References Cited

U.S. PATENT DOCUMENTS

| | | | | |
|---|---|---|---|---|
| 2,897,897 | A * | 8/1959 | Breukelman | E21B 49/08 166/134 |
| 10,345,481 | B2 * | 7/2019 | Freed | E21B 49/10 |
| 2005/0194184 | A1 * | 9/2005 | Gleitman | E21B 47/00 703/10 |
| 2006/0155473 | A1 * | 7/2006 | Soliman | E21B 49/00 702/12 |
| 2008/0135239 | A1 * | 6/2008 | Edwards | E21B 49/081 166/264 |
| 2011/0162849 | A1 * | 7/2011 | Soliman | E21B 49/00 166/308.1 |
| 2011/0198078 | A1 * | 8/2011 | Harrigan | E21B 49/087 166/254.2 |
| 2012/0279702 | A1 * | 11/2012 | Bedouet | E21B 49/08 166/250.03 |
| 2014/0182844 | A1 * | 7/2014 | Wutherich | E21B 47/06 166/250.1 |
| 2015/0129211 | A1 * | 5/2015 | Dusseault | E21B 49/006 166/280.1 |
| 2015/0376975 | A1 * | 12/2015 | Flores | E21B 33/128 166/185 |
| 2018/0135359 | A1 * | 5/2018 | Hradecky | E21B 23/14 |
| 2019/0292889 | A1 * | 9/2019 | Hansen | E21B 43/128 |
| 2019/0345797 | A1 * | 11/2019 | Babic | E21B 47/07 |
| 2020/0308477 | A1 * | 10/2020 | Patil | C09K 8/88 |
| 2021/0054736 | A1 * | 2/2021 | Moos | E21B 43/00 |
| 2021/0246782 | A1 * | 8/2021 | Eng | G01B 17/00 |

* cited by examiner

*Primary Examiner* — Neel Girish Patel

(74) *Attorney, Agent, or Firm* — Kyle R. Miiller

(57) ABSTRACT

Embodiments presented provide for stress testing of downhole wireline formation testing equipment. Certain embodiments provide for stress testing of geological stratum which exhibit high permeability.

6 Claims, 4 Drawing Sheets

METHOD AND APPARATUS FOR STRESS TESTING OF GEOLOGICAL FORMATIONS WITH A HIGH PERMEABILITY

CROSS-REFERENCE TO RELATED APPLICATIONS

None.

FIELD OF THE DISCLOSURE

Aspects of the disclosure relate to stress testing of geological formations. More specifically, aspects of the disclosure relate to stress testing with formation testers used in the hydrocarbon recovery industry.

BACKGROUND

Stress tests for geological formations are conducted on geological stratum for a variety of reasons. One of the objectives of stress testing of geological formations is to determine different stresses, such as the minimum horizontal stress, which is a key parameter for wellbore stability analysis and hydraulic fracturing design. Stress testing involves injecting fluid into an isolated interval of the formation until a fracture is initiated or propagated. The injection pressure at which this occurs is called the breakdown pressure or the fracture propagation pressure, respectively. To perform stress testing with formation testers, the tool must be able to generate high flow rates and pressures, and inject the desired fluid type. Different methods and challenges of stress testing with formation testers are discussed in the following paragraphs.

Stress testing works very well when permeabilities are low to medium (e.g. up to 100 mD). When permeability is higher, however, problems are encountered. In these scenarios, the flow rates required to propagate a fracture may not be achievable with formation testers' downhole pumps as the fluid loss dominates or prevents fracture propagation during injection at maximum achievable rates. When an interval isolated by a dual packer system is extended over the default values (1 to 2 meters), up to 15 meters for example, these distances can be difficult to create sufficiently high flowrates to generate or propagate a fracture. This is particularly problematic when injecting clear fluids, also known as solids-free fluids. It is known in the industry that conducting stress tests with clear fluids can result in higher quality data than when wellbore mud is injected. Clear fluids often have a lower viscosity than mud and require even higher rates to overcome the even higher fluid losses that prevent the generation of the required injection pressures.

When a fluid other than borehole fluid is to be injected during a stress test with a wireline formation tester, this fluid is normally carried in a chamber in the formation tester tool string. Such chambers normally have a volume between 1 and 6 gallons and several chambers can be combined in a single tool string. Considering that 1 stress testing station requires fluid to inflate the dual packer and consists of 1 breakdown cycle and a minimum of 3 injection/propagation cycles (and normally more), the number of fluid tests that may be performed with chambers is limited.

A different testing system, known as Formation Tester Deep Injection Testing (FDIT), may be used in specialized circumstances. In this system, a formation tester is conveyed with drill pipe (DP), and an active circulating sub connects the drill pipe with the formation tester. With this configuration, a desired fluid can be spotted in the drill pipe while the circulating sub is open. The circulating sub connection to the borehole is then closed and the formation tester flowline is opened to the reservoir section isolated by the dual packers. Surface pumps can then push the drill pipe fluid at a high rate into the reservoir. This specialized purpose testing is only used in geological formations and does not fracture the formation.

There is a need to be able to conduct wireline-based stress testing of geological formations with a high permeability.

There is a further need to be able to conduct such wireline-based stress tests with a solids free fracture fluid to enable better results to be retained from tests performed.

There is a further need to be able to conduct fracture propagation at different rates, over larger isolated intervals than conventional testing methods and systems.

There is a need to provide an apparatus and methods that are easier to operate than conventional apparatus and methods.

There is a still further need to reduce economic costs associated with operations and apparatus described above with conventional tools and testing methods.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a method to perform a stress test on a geological formation is disclosed. The method may comprise conveying a bottom hole assembly on a drill pipe to a testing location. The method may further comprise setting at least two packers at the testing location in a wellbore. The method may further comprise performing an injection of a fluid obtained from the drill pipe into the testing location in the geological formation. The method may further comprise stopping the injection of the fluid from the drill pipe. The method may further comprise performing at least one breakdown cycle injection with the fluid from the drill pipe. The method may further comprise determining when the at least one breakdown cycle injection with fluid results in an open reservoir. The method may further comprise performing an injection followed by falloff cycles using surface based pumps into the geological formation. The method may further comprise deflating the at least two packers.

In another example embodiment, a method to perform a stress test on a geological formation is disclosed. The method may comprise conveying a bottom hole assembly on a drill pipe to a testing location. The method may further comprise setting at least two packers at the testing location in a wellbore. The method may further comprise performing an injection of a fluid obtained from the drill pipe into the testing location in the geological formation. The method may further comprise stopping the injection of the fluid from the drill pipe. The method may further comprise performing at least one breakdown cycle injection with the fluid from the drill pipe. The method may further comprise determining when the at least one breakdown cycle injection with fluid results in an open reservoir. The method may further comprise performing an injection followed by falloff cycles using downhole-based equipment into the geological formation. The method may further comprise deflating the at least two packers.

In another example embodiment, a method to perform a stress test on a geological formation is disclosed. The method may comprise conveying a bottom hole assembly on a drill pipe to a testing location. The method may also comprise setting a dual packer at the testing location in a wellbore. The method may also comprise performing an injection of a solids-free fluid obtained from the drill pipe into the testing location in the geological formation. The method may also comprise stopping the injection of the fluid from the drill pipe. The method may also comprise performing at least one breakdown cycle injection with the fluid from the drill pipe. The method may also comprise performing an injection propagation cycle with the bottom hole assembly using the solids-free fluid. The method may also comprise determining when the at least one breakdown cycle injection with fluid results in an open reservoir. The method may also comprise performing an injection followed by falloff cycles using downhole based equipment into the geological formation when the open reservoir is determined. The method may also comprise deflating the at least two packers.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and, are therefore not to be considered limiting of its scope for the disclosure may admit to other equally effective embodiments.

Figure 1:
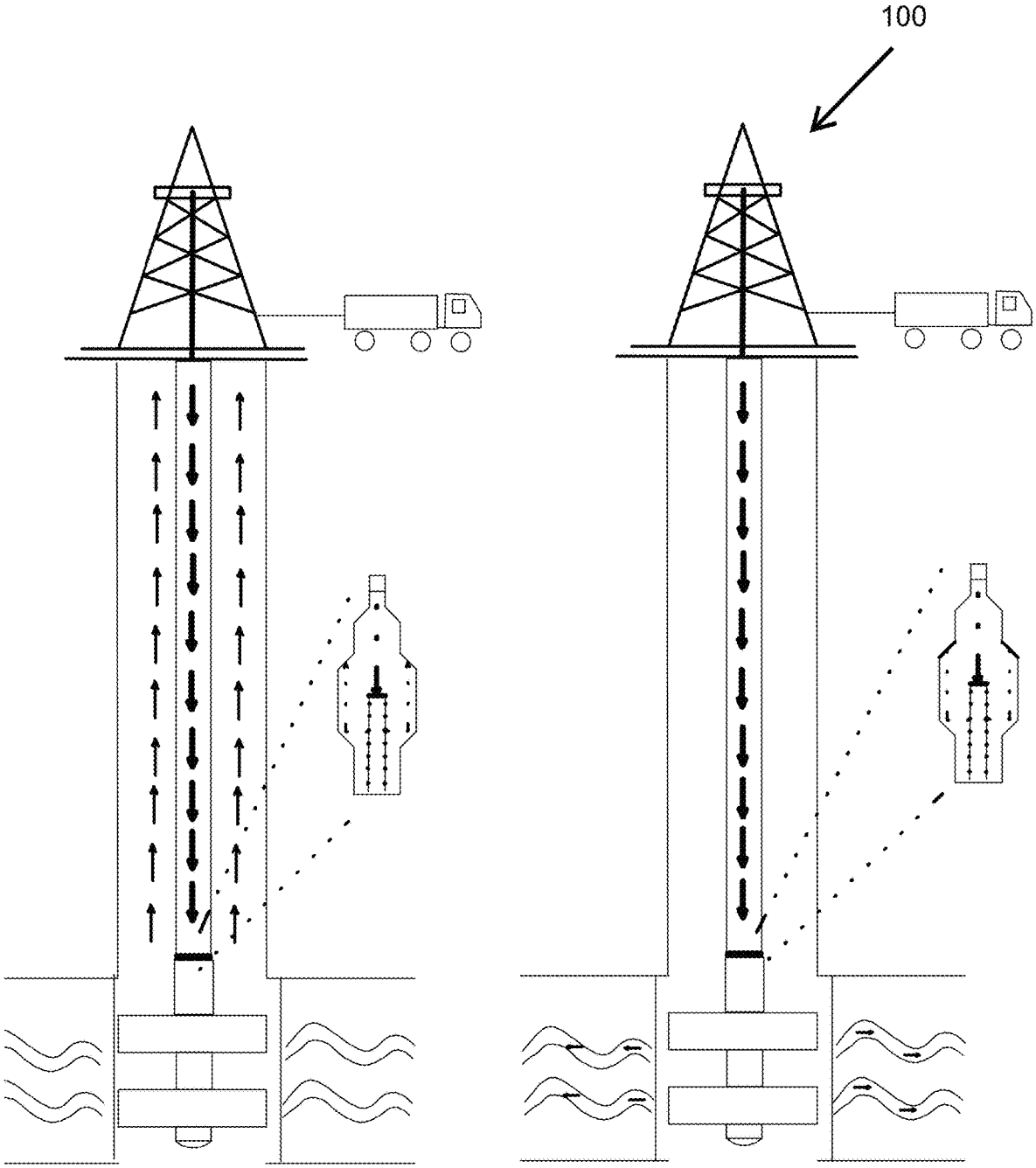
FIG. 1 illustrates a side view of a Formation Tester Deep Injection Testing system, wherein in the left frame fluid is circulating prior to injection and in the right frame the fluid is injected into a geological stratum.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments, and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers, and/or sections, these elements, components, regions, layers, and/or sections should not be limited by these terms. These terms may be only used to distinguish one element, components, region, layer, or section from another region, layer, or section. Terms such as "first", "second", and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

When an element or layer is referred to as being "on", "engaged to", "connected to", or "coupled to" another element or layer, it may be directly on, engaged, connected, or coupled to the other element or layer, or interleaving elements or layers may be present. In contrast, when an element is referred to as being "directly on", "directly engaged to", "directly connected to", or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

FIG. 1 schematically depicts one example embodiment of a formation tester deep injection testing system 100 of the disclosure. In the left part of FIG. 1, fluid is circulated into the drill pipe and pre-existing drill pipe fluid is pushed into the annulus through the circulating sub. In this depiction, the annulus is open to surface, thereby providing a return path for the borehole fluid. A predefined volume of fluid (e.g. several hundred liters) can be pumped down, followed by a spacer fluid (to separate fluid slugs) and mud (or other injection fluid).

Once the fluid is in place as illustrated in FIG. 1, the circulating sub connection to the borehole is closed. The volume of fluid to be used can be calculated from known drill pipe volume and measured flowrates. Other possibilities exist for calculating the volume, such as taking measurements from a formation tester fluid analyzer.

Referring to FIG. 1, right side, a flow path is shown. In this portion, fluids in the drill pipe are forced through the formation tester flowlines and into the formation using surface pumps.

In the configuration illustrated in FIG. 1, high injection rates may be achieved. In some example embodiments, 5000 psi surface pressure may be achieved. Lower or higher values may be achieved by using larger flow lines and alternative equipment.

Figure 3A:
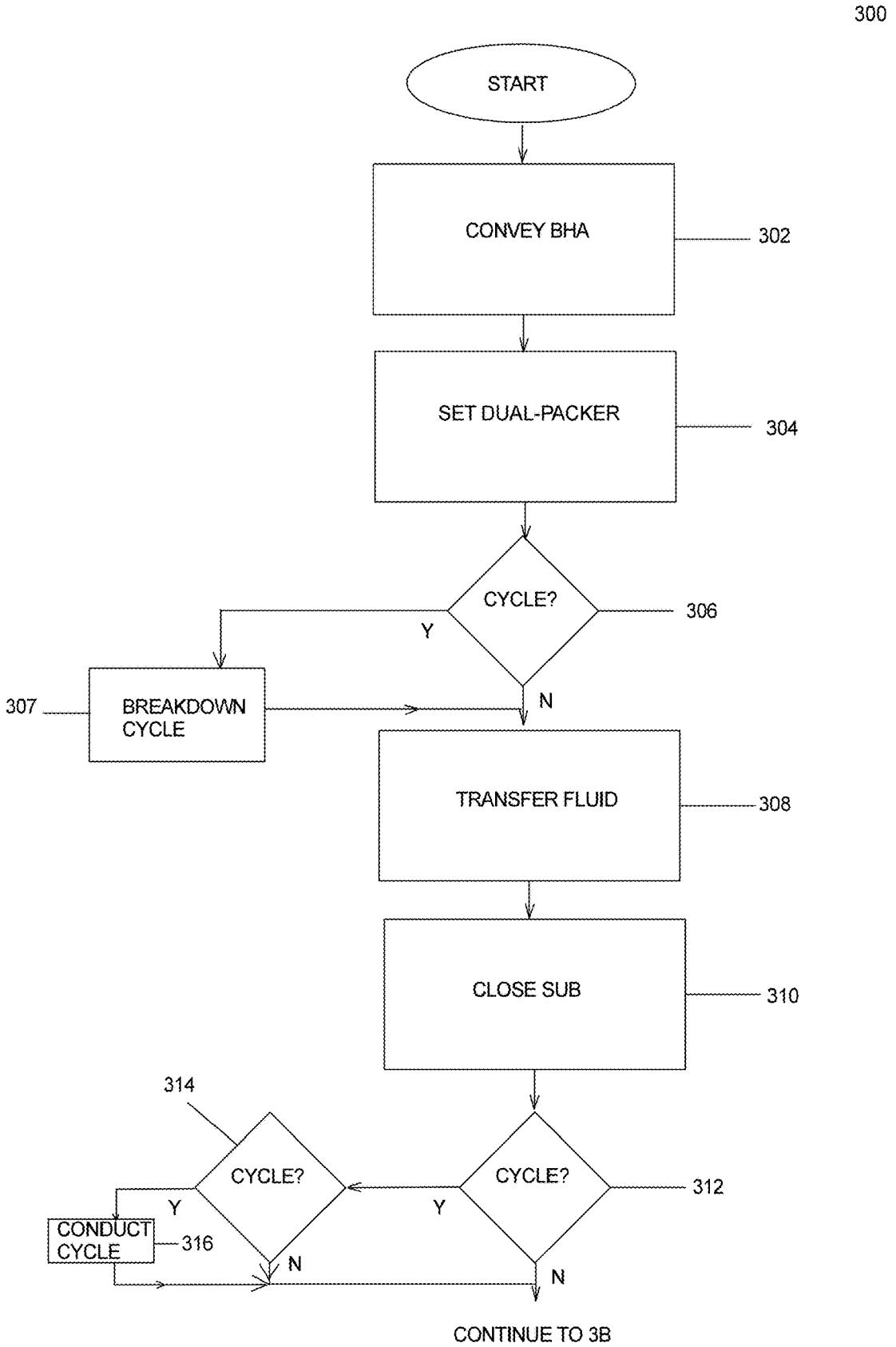
FIG. 3A and FIG. 3B are a method of performing a wireline-based stress testing of geological formations with a high permeability in accordance with one example embodiment of the disclosure.
Figure 3B:
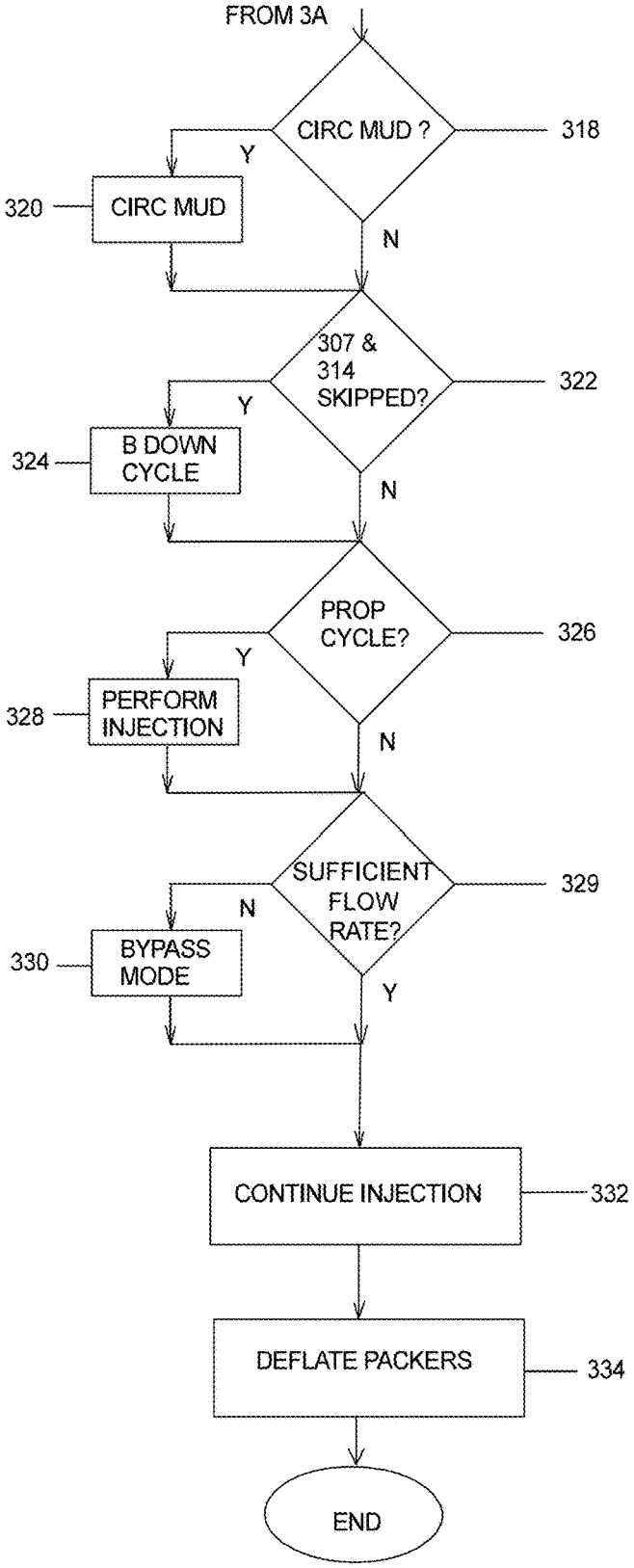

Referring to FIG. 3, a method 300 for performing a wireline-based stress testing of a geological formation with high permeability is illustrated. In some instances, it may be noted that formed mud cake may hold pressure for a breakdown cycle. In some instances, the method 300 may be altered when a fracture already exists, for clean fluid injection and for large interval spacing injection. The method 300 may comprise, at 302, conveying a testing apparatus on drill pipe to a desired elevation to be tested. The method 300 may also comprise, at 304, setting a dual packer arrangement for an interval to be tested. In some embodiments, a pretest of the geological stratum may be accomplished at 304. In some embodiments, at 304, a slip joint may be established if engineers or field personnel determine that drill pipe expansion or contraction is predicted. This slip joint will allow for a leak tight seal for the system. At 306, a query is performed to determine if field personnel wish to run an optional breakdown cycle using the downhole pumps and mud from the borehole or drill pipe. If the response to 306 is yes, then the optional breakdown cycle at 307 is performed, and the method is returned to step 308. If the query at 306 is no, then the method proceeds to 308. At 308, the method continues with spotting the fluid to be injected at the bottom of the drill pipe. In this instance, a circulating sub is used and placed in an open position. In embodiments, injection fluids are typically solids-free and are designed for optimal viscosity at the reservoir temperature. At 310, the circulating sub is closed. At 312, a query is run to determine if the optional breakdown cycle at 307 was skipped, then a query may be run at 314 to ask if a breakdown cycle is needed. If a breakdown cycle is needed, then, it is performed at 316 and the method is returned to 318. If a break-down cycle is not desired at 314, the method may return to 318.

At 318, the method proceeds with a query on if circulating out mud from the dual packer interval is desired. If circulation is to be performed, then circulation is performed at 320 and drill pipe injection fluid may be used. After 320, the method returns to 322. If circulation is not to be performed at 318, then the method proceeds directly to 322, where the method proceeds to perform a query on if steps 307 and 314 were skipped. If these steps were skipped, then a breakdown cycle using downhole pumps with fluid from the drill pipe may be performed at 324. If breakdown cycles were not previously skipped in the query at 322, the method progresses to 326. At 326, the method continues by running a query by field engineers if it is desired to perform an optional injection propagation cycle using drill pipe fluid. This is to check if sufficient propagation pressure can be generated with the downhole pumps to test a propagation cycle. If successful, continue with injection/fall off cycles using the downhole pumps. If it is desired at 326, the injection occurs at 328 with the method then returning to 329. If the query at 326 responds that an injection is not needed, the method proceeds directly to 329.

If step 329 shows that the path to the reservoir is open, but the downhole pumps cannot generate sufficient flowrates, then flowlines are placed in bypass mode and an injection followed with observing fall of cycles is accomplished at 330. The method then returns to 332. The injection at 330 may be performed by running the surface pumps and forcing drill pipe fluid from the drill pipe through the flowlines into the fracture.

At 332, the method may continue with high-rate injection and falloff cycles, using surface pumps or downhole pumps and solids-free drill pipe fluid. At 334, the method may continue with deflating the dual packers and with a movement to a next station, if required.

If the formation permeability is too low for the fracture to close by fracture fluid leak-off into the formation, then active flowback may be required. Several different flowback methods exist, such as flowback using a downhole pump. Downhole pumps can be used to pump fluid from the fracture in a slow and controlled manner. It should be noted that pumps with passive mud check valves may only pump fluid from a given inlet pressure to a higher outlet pressure. If the outlet pressure is lower than the inlet pressure, then the fluid will free flow through the mud check valve, bypassing the pump.

Flowback Using the Downhole Pump

Whether injection was performed conventionally with downhole pumps and borehole mud, or through the workflow described in the previous section, the active circulating sub can assist with flowback operations.

During steps 329 and 332, in the previously described stress test method, fluid is forced from surface, through the drill pipe and fluid testing flowlines, and into the dual packer interval. At the end of a fracture propagation cycle, the drill pipe can be closed on the surface. The pressure at the bottom of the drill pipe, the flow tester flowlines and in the fracture will be roughly the same (ignoring changes in hydrostatic head).

Alternatively, when injection is performed using the downhole pumps, the drill pipe pressure can be increased from surface after the downhole injection cycle is finished. This should again result in equalized pressure in the fracture, the flowline and the bottom of the drill pipe.

Figure 2:
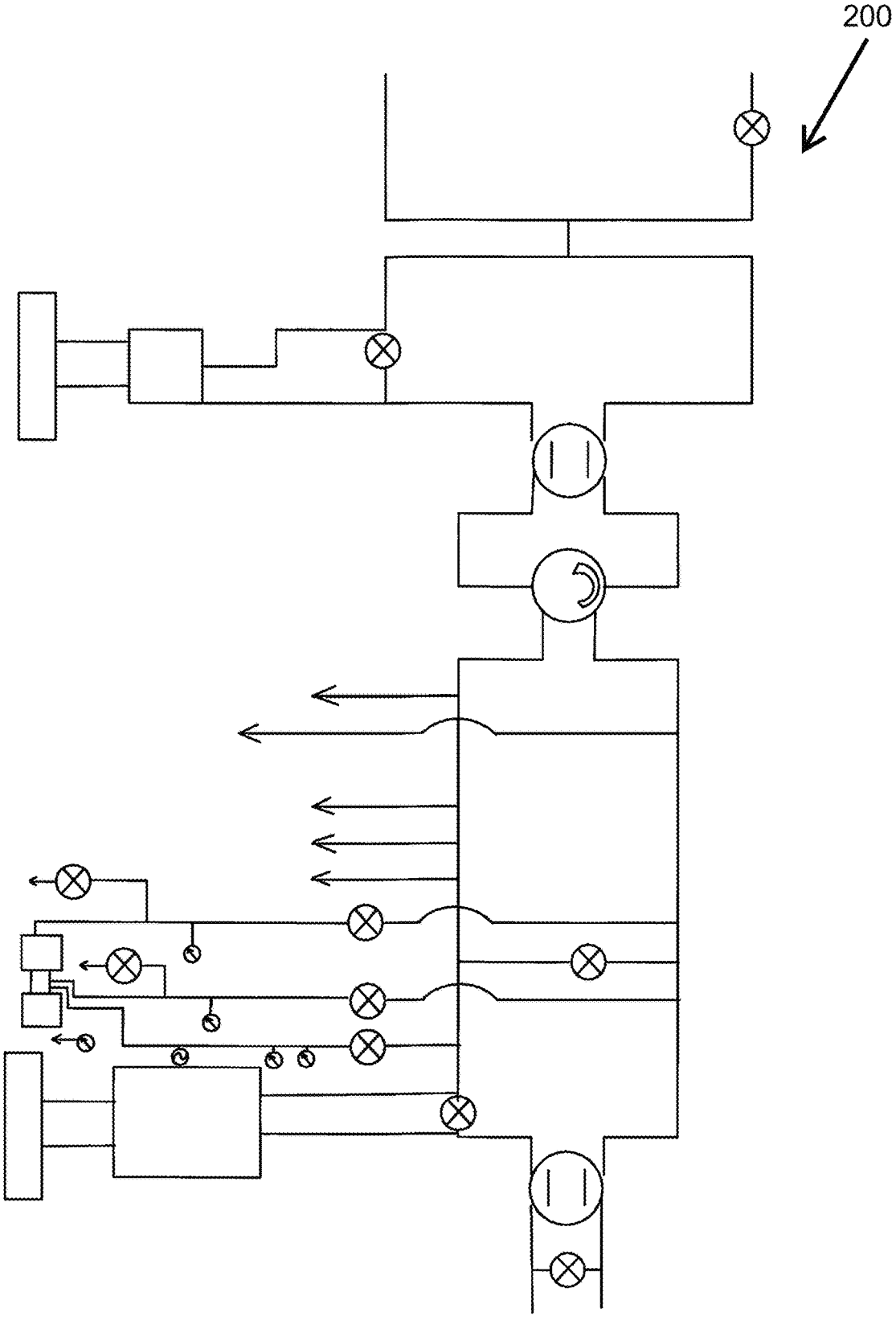
FIG. 2 is an example tool string showing the components of the formation tester deep injection testing system.

An upper formation testing pump 200, as illustrated in FIG. 2, can now be switched to up-mode and can be used to pump fluid from the fracture into the drill pipe. During pumping, fracture pressure will decrease, and drill pipe pressure will increase slightly (depending on the volume and compressibility of the drill pipe fluid). In this configuration, fluid is pumped with fracture pressure at the pump inlet and a higher pressure at the pump outlet, allowing controlled flowback driven by the downhole pump.

The embodiments described are able to conduct wireline-based stress testing of geological formations with a high permeability and flow back can be performed when permeability is low.

The embodiments described are able to conduct such wireline-based stress tests with a solids free, higher viscosity fracture fluid to enable better results to be retained from tests performed.

The embodiments described are able to conduct fracture propagation over larger isolated intervals than conventional testing methods and systems.

The embodiments described are able to provide an apparatus and methods that are easier to operate than conventional apparatus and methods.

The embodiments described are able to reduce economic costs associated with operations and apparatus described above with conventional tools and testing methods.

Embodiments of the disclosure may provide for an article of manufacture that contains a non-transitory memory product. The non-transitory memory product may be configured to retain data, such as method steps. The non-transitory memory product may contain stored data and be read by a device. Such devices may be computing devices such as a laptop computer, main frame computer, computer cell phone, or other similar device. The method steps may be used, for example, to control a computer or perform mathematical calculations. In turn, the computer may instruct other systems, machines, or components. Examples of non-transitory memory products may include universal serial bus devices, solid state memory arrangements, compact discs, or computer hard drives. In some instances, the non-transitory device may be configured with a device that reads the stored information and transmits the data to a separate location. In some embodiments, artificial intelligence may be used in conjunction with the data stored on the article of manufacture to perform various functions.

Further embodiments may include methodologies that allow computers to be trained to allow for more comprehensive and accurate answers. Such training may be performed in nodes that may be used to allow for fine tuning of results. Upon retention of results of calculations, the method steps may be altered such that results that are not accurate are precluded from future calculations by amending method steps accomplished in various nodes. Such alterations are contemplated and are within the scope of this disclosure.

Example embodiments of the claims will be described next. The description of these claims should not be considered limiting of the disclosure. In one example embodiment, a method to perform a stress test on a geological formation is disclosed. The method may comprise conveying a bottom hole assembly on a drill pipe to a testing location. The method may further comprise setting at least two packers at the testing location in a wellbore. The method may further comprise performing an injection of a fluid obtained from the drill pipe into the testing location in the geological formation. The method may further comprise stopping the injection of the fluid from the drill pipe. The method may further comprise performing at least one breakdown cycle injection with the fluid from the drill pipe. The method may further comprise determining when the at least one breakdown cycle injection with fluid results in an open reservoir. The method may further comprise performing an injection followed by falloff cycles using surface based pumps into the geological formation. The method may further comprise deflating the at least two packers.

In another example embodiment, the method may further comprise setting a slip joint after setting of the packer.

In another example embodiment, the method may be performed wherein the setting of the at least two packers is the setting of a dual packer.

In another example embodiment, the method may further comprise circulating out mud from between the dual packer and circulating in the drill pipe fluid between the dual packer after the circulating out of the interval of mud.

In another example embodiment, the method may be performed wherein the stopping the injection of fluid from the drill pipe includes closing a circulating sub.

In another example embodiment, the method may further comprise conveying the bottom hole assembly on the drill pipe to a second testing location.

In another example embodiment, a method to perform a stress test on a geological formation is disclosed. The method may comprise conveying a bottom hole assembly on a drill pipe to a testing location. The method may further comprise setting at least two packers at the testing location in a wellbore. The method may further comprise performing an injection of a fluid obtained from the drill pipe into the testing location in the geological formation. The method may further comprise stopping the injection of the fluid from the drill pipe. The method may further comprise performing at least one breakdown cycle injection with the fluid from the drill pipe. The method may further comprise determining when the at least one breakdown cycle injection with fluid results in an open reservoir. The method may further comprise performing an injection followed by falloff cycles using downhole-based equipment into the geological formation. The method may further comprise deflating the at least two packers.

In another example embodiment, the method may further comprise conveying the bottom hole assembly on the drill pipe to a second testing location.

In another example embodiment, the method may be performed wherein the setting of the at least two packers is the setting of a dual packer.

In another example embodiment, the method may further comprise circulating out an interval of mud from between the dual packer.

In another example embodiment, the method may further comprise circulating in the drill pipe fluid between the dual packer after the circulating out of the interval of mud.

In another example embodiment, a method to perform a stress test on a geological formation is disclosed. The method may comprise conveying a bottom hole assembly on a drill pipe to a testing location. The method may also comprise setting a dual packer at the testing location in a wellbore. The method may also comprise performing an injection of a solids-free fluid obtained from the drill pipe into the testing location in the geological formation. The method may also comprise stopping the injection of the fluid from the drill pipe. The method may also comprise performing at least one breakdown cycle injection with the fluid from the drill pipe. The method may also comprise performing an injection propagation cycle with the bottom hole assembly using the solids-free fluid. The method may also comprise determining when the at least one breakdown cycle injection with fluid results in an open reservoir. The method may also comprise performing an injection followed by falloff cycles using downhole-based equipment into the geological formation when the open reservoir is determined. The method may also comprise deflating the at least two packers.

In another example embodiment, the method may further comprise setting a slip joint after conveying the bottom hole assembly on the drill pipe to the testing location.

In another example embodiment, the method may further comprise performing a breakdown cycle of the geological formation at the bottom hole assembly through one of a connection at the top of the drill pipe and the storage of the solids-free fluid within the downhole assembly.

In another example embodiment, the method may further comprise moving the bottom hole assembly to a second position within the wellbore.

In another example embodiment, the method may further comprise performing the method a second time.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method to perform a stress test on a geological formation, comprising:

conveying a bottom hole assembly on a drill pipe to a testing location;

setting at least two packers at the testing location in a wellbore;

circulating a solids free fluid into the drill pipe;

using the solids free fluid with one or more downhole pumps to create an injection fall off cycle;

initiating a bypass mode when the one or more downhole pumps cannot generate a sufficient flow by initiating use of one or more surface pumps to generate a higher flowrate of the solids free fluid;

performing an injection of the solids free fluid obtained from the drill pipe into the testing location in the geological formation;

stopping the injection of the solids free fluid from the drill pipe, wherein the stopping the injection of the solids free fluid from the drill pipe includes closing a circulating sub; and deflating the at least two packers.

2. The method according to claim 1, wherein the method further includes setting a slip joint after setting of the at least two packers.

3. The method according to claim 1, wherein the setting of the at least two packers is the setting of a dual packer.

4. The method according to claim 3, further comprising:

circulating out an interval of mud from between the dual packer; and circulating in the solids free fluid from the drill pipe between the dual packer after the circulating out of the interval of mud.

5. The method according to claim 1, further comprising:

conveying the bottom hole assembly on the drill pipe to a second testing location.

6. The method according to claim 1, wherein the injection comprises a large volume of the solids free fluid.

* * * * *